US006722347B2

(12) United States Patent
Sanchez et al.

(10) Patent No.: US 6,722,347 B2
(45) Date of Patent: Apr. 20, 2004

(54) CONTROL ROUTINE FOR A CURRENT DRIVER

(75) Inventors: Ramon A Sanchez, Chihuahua (MX); Esau Aguinaga, Chihuahua (MX)

(73) Assignee: Delphi Technologies, Inc., Troy, MI (US)

( * ) Notice: Subject to any disclaimer, the term of this patent is extended or adjusted under 35 U.S.C. 154(b) by 40 days.

(21) Appl. No.: 10/199,930

(22) Filed: Jul. 19, 2002

(65) Prior Publication Data

US 2004/0011339 A1 Jan. 22, 2004

(51) Int. Cl.[7] ..... F02M 33/02
(52) U.S. Cl. ..... 123/520; 251/129.15
(58) Field of Search ..... 123/520, 519, 123/518; 251/129.05, 129.15, 129.18; 60/283, 285

(56) References Cited

U.S. PATENT DOCUMENTS 6,102,364 A * 8/2000 Busato ..... 251/129.05
6,152,116 A * 11/2000 Duty ..... 123/520

* cited by examiner

*Primary Examiner*—Mahmoud Gimie
(74) *Attorney, Agent, or Firm*—Jimmy L. Funke

(57) ABSTRACT

A method and apparatus for controlling a solenoid-actuated charcoal canister purge valve to control the flow of purge fuel that is supplied via the purge valve to a cylinder of an internal combustion engine. The method includes generating a preselected input duty cycle for use in energizing the solenoid-actuated purge valve that is registered by a microcontroller. The solenoid-actuated purge valve is energized using the input duty cycle to generate an output duty cycle from a current driver in operable communication with the microcontroller. The output duty cycle dictates the quantity of purge fuel flow to the cylinder by controlling the active period of energizing the solenoid. A feedback voltage (Vfb) from the solenoid-actuated purge valve is measured, wherein the feedback voltage (Vfb) corresponds to a feedback duty cycle (DCfb). The microcontroller calculates an error between the input duty cycle (Idc) and the feedback duty cycle (DCfb) and generates a compensated output duty cycle to the current driver based on the error calculated to compensate any deviation. The compensated output duty cycle compensates for any deviation from a linear relationship between the input duty cycle (Idc) and feedback voltage (Vfb), wherein Vfb corresponds to a flow of purge fuel.

22 Claims, 4 Drawing Sheets

CONTROL ROUTINE FOR A CURRENT DRIVER

TECHNICAL FIELD

The present invention relates generally to a control routine for devices used to control the flow of petroleum fuel vapors between a carbon canister and a combustion engine.

BACKGROUND

In order to comply with state and federal environmental regulations, most motor vehicles are now equipped with a carbon canister installed to trap and store petroleum fuel vapors from the carburetor bowl and/or the fuel tank. With the canister, fuel vapors are not vented to the atmosphere, but are instead trapped in the canister and then periodically purged from the canister into the engine where they are burned along with the air-fuel mixture. A solenoid is typically used to control purging of the carbon canister.

The solenoid mechanism includes a plunger that is movable between an open position, wherein the outlet port is not blocked and purge air communicates with the carbon canister, and a closed position, wherein the outlet port is blocked. When the coil within the cylindrical solenoid mechanism is energized, the magnetic force of the coil will attract the plunger collar and draw it toward the coil causing the plunger to move within the plunger guide to the open position. This motion will release a valve cap from a valve seat and open the air outlet nipple. The solenoid valve for a vehicle carbon canister will stay open as long as the coil is energized.

A spring is installed in compression within the plunger to bias the plunger in a closed position. When the coil within the cylindrical solenoid mechanism is de-energized, the spring returns the plunger to the closed position, with the valve cap pressed tightly against the valve seat, and blocks the flow of air through the solenoid valve for a vehicle carbon canister. The solenoid valve for a vehicle carbon canister will remain closed as long as the coil remains de-energized.

A pulse width modulated signal (PWM) modulates the duty cycle to obtain a certain percentage of the period in an active mode (i.e., energizing the coil). The frequency of operation determines the total period and the average current applied to the coil of the solenoid. This current generates a magnetic field that activates the plunger to compress the spring from a normally closed position. The spring constant of the spring is chosen so that the closure force of the spring will be greater than the force of the air pressure on the plunger collar. This will keep the plunger in the closed position (not shown) when the coil is de-energized. However, the spring constant is also chosen so that the magnetic force of the coil will overcome the spring force when the coil is energized and keep the plunger in the open position. In this manner, the movement of the plunger is proportional to the duty cycle that is being applied to the solenoid.

A high frequency is typically applied to the solenoid to diminish noise and lower power consumption. However, high frequency hinders the linearity of the proportional function of the solenoid and increases the hysteresis of the system because the activation pulses are so close in time that the pulses tend to meld with each other. Furthermore, when high frequency is applied, the plunger does not have time to fully travel the distance between the fully closed position and the fully open positions. Instead, the plunger vibrates or "dithers" proportionally to the frequency. It is known to control dithering by using a current driver to generate a proportional function between the average current and the input duty cycle. However, this requires the measurement of average current in real time which is difficult to determine.

Thus, there is a need for an apparatus and method for accurately controlling the purging of a carbon canister that will minimize dithering when a high frequency is applied.

SUMMARY

The above discussed and other drawbacks and deficiencies are overcome or alleviated by a method and apparatus for controlling a solenoid-actuated charcoal canister purge valve to control the flow of purge fuel that is supplied via the purge valve to a cylinder of an internal combustion engine. The method and apparatus measure a feedback voltage (Vfb) of the solenoid as an indirect measurement of the average current Iavg applied to the solenoid. A microcontroller registers and generates a preselected input duty cycle (Idc) for use in energizing the solenoid- actuated purge valve. The input duty cycle energizes the solenoid-actuated purge valve using the input duty cycle to generate an output duty cycle from a current driver. The output duty cycle energized the solenoid to open to thereby supply a quantity of purge fuel to the cylinder. The feedback voltage (Vfb) is measured from the solenoid-actuated purge valve, wherein the feedback voltage (Vfb) corresponds to a feedback duty cycle (DCfb). An error between the input duty cycle (Idc) and the feedback duty cycle (DCfb) is calculated. The error is received by a proportional integral derivative (PID) control routine which generates a compensated output duty cycle to the current driver based on the error calculated to compensate for any deviation. The compensated output duty cycle compensates for any deviation from a linear relationship between the input duty cycle (Idc) and feedback voltage (Vfb), wherein Vfb corresponds to a flow of purge fuel. The microcontroller employs a reset function that uses a programmed feedback voltage corresponding to a certain duty cycle to be applied to control the average current applied to the solenoid-actuated purge valve. The reset function uses a set of programmable variables that include variables selected to change a slope of a proportional curve (Idc vs. Flow) for controlling the opening point and a linear dynamic range of the solenoid.

BRIEF DESCRIPTION OF THE DRAWINGS

Referring to the exemplary drawings wherein like elements are numbered alike in the several Figures.

DETAILED DESCRIPTION

Figure 1:
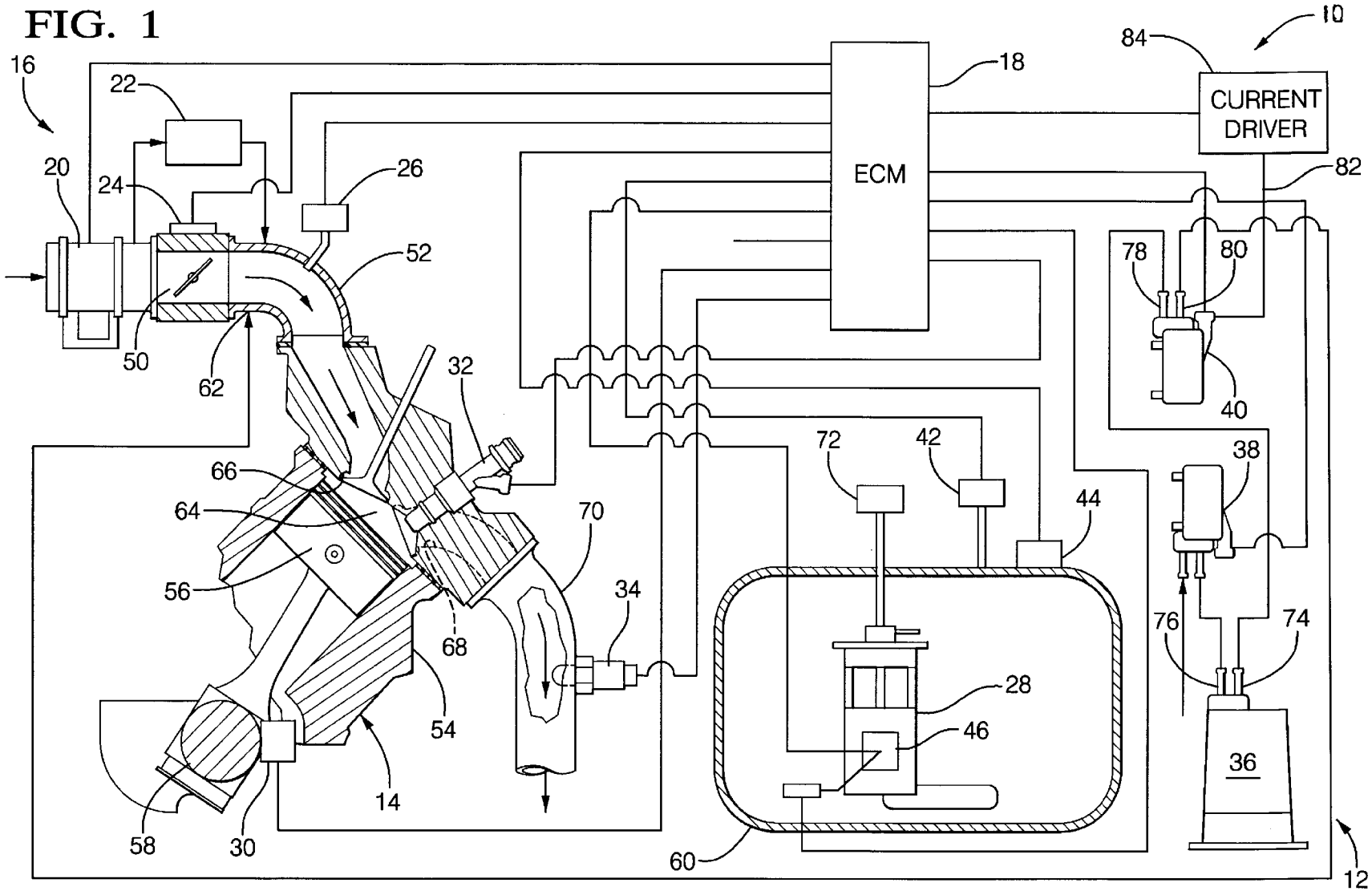
FIG. 1 is a diagrammatic view, showing a fuel injection system and evaporative emission control system that are integrated together into a single fuel control system for an automotive internal combustion engine employing an exemplary embodiment of a control routine.

Referring to FIG. 1, there is shown a fuel injection system 10 and evaporative emission control system (EECS) 12 for an internal combustion engine 14. While fuel injection system 10 and EECS 12 can be implemented separately, in the preferred embodiment shown in FIG. 1 they are integrated together into a single fuel control system 16. In general, EECS 12 manages evaporative emissions from the stored fuel that is used to operate engine 14 and provides the vaporized fuel to engine 14 when necessary. Fuel injection system 10 determines the amount of fuel to be injected each engine cycle, taking into account any fuel vapors provided by EECS 12. In this way, evaporative emissions from the stored fuel can be used in engine operation, rather than being lost to the environment, and can be accounted for in the fuel calculations so that the engine 14 can be operated in a manner that minimizes exhaust emissions.

Fuel injection system 10 includes an electronic control module (ECM) 18, a mass airflow meter 20, idle air control valve 22, throttle position sensor 24, manifold absolute pressure (MAP) sensor 26, fuel sender 28, engine speed sensor 30, solenoid-operated fuel injector 32, and exhaust gas oxygen ($O_2$) sensor 34. EECS 12 includes ECM 18 as well as a charcoal canister 36, canister vent valve 38, purge valve 40, fuel tank pressure sensor 42, fuel tank temperature sensor 44, and a tank level sensor 46 that can be a part of fuel sender 28. The components of fuel injection system 10 and EECS 12 all form a part of fuel control system 16 and these components can be conventional parts connected together in a manner that is well known to those skilled in the art. As will be appreciated, fuel control system 16 may also include a number of other components known to those skilled in the art that can be used in a conventional manner to determine the quantity of fuel to be injected each cycle. Such components can include, for example, an engine temperature sensor and an air temperature sensor incorporated into or located near the airflow meter 20, neither of which is shown in FIG. 1.

ECM 18 contains the software programming necessary for implementing the evaporative emissions control, fuel quantity calculations, and fuel injection control provided by fuel control system 16. As will be known to those skilled in the art, ECM 18 is a microprocessor-based controller having random access (RAM) and read-only memory (ROM), as well as non-volatile re-writable memory for storing data that must be maintained in the absence of power (e.g., EEPROM). ECM 18 includes a control program stored in ROM that is executed each time the vehicle is started to control fuel delivery to the engine. ECM 18 also includes suitable analog to digital (A/D) converters for digitizing analog signals received from the various sensors, as well as digital to analog (D/A) converters and drivers for changing digital command signals into analog control signals suitable for operating the various actuators shown in FIG. 1. ECM 18 is connected to receive inputs from airflow meter 20, throttle position sensor 24, MAP sensor 26, engine speed sensor 30, O 2 sensor 34, purge valve 40, tank pressure sensor 42, tank temperature sensor 44, and tank level sensor 46. ECM 18 is connected to provide actuating outputs to idle air control valve 22, fuel sender 28, fuel injector 32, canister vent valve 38, and purge valve 40.

The components of engine 14 relevant to fuel control system 16 include an engine throttle 50, intake manifold 52, a number of cylinders 54 and pistons 56 (only one of each shown), and a crankshaft 58 for creating reciprocal motion of the piston within cylinder 54. Throttle 50 is a mechanical throttle that is connected downstream of airflow meter 20 at the entrance of intake manifold 52. Throttle 50 is controlled by the vehicle operator and its position sensor 24 is used to provide ECM 18 with a signal indicative of throttle position. Idle air control valve 22 provides a bypass around throttle 50, and it will be appreciated that an electronically-controlled throttle could be used in lieu of idle air control valve 22 and mechanical throttle 50.

Purge valve 40 feeds purge air from charcoal canister 36 and/or fuel tank 60 into the intake manifold at a purge port 62 that is located just downstream of the throttle. Thus, the intake air that flows through manifold 52 comprises the air supplied by idle air control valve 22, purge valve 40, and throttle 50. MAP sensor 26 is connected to intake manifold 52 to provide the ECM with a signal indicative of gas pressure within the intake manifold. In addition, to determine appropriate fuel quantities, it can be used to provide a reading of the barometric pressure, for example, prior to engine cranking.

At the cylinder end of intake manifold 52, air flows into a combustion chamber 64, which is merely the space within cylinder 54 above piston 56. The intake air flows through a valve (not shown) at the intake port 66 of the cylinder and then into the combustion chamber. Fuel injector 32 can be placed in a conventional location upstream of the intake port 66 or within the cylinder head in the case of direct injection. After combustion, the exhaust exits the cylinder through a valve (not shown) at an exhaust port 68 and is carried by an exhaust pipe 70 past O 2 sensor 34 and to a catalytic converter (not shown). As will be appreciated by those skilled in the art, this $O_2$ sensor can either be a wide-range air/fuel sensor or a switching sensor.

As shown in FIG. 1, evaporative emissions from the fuel in tank 60 are fed by way of a rollover valve 72 to a first port 74 of charcoal canister 36. These vapors enter canister 36, displacing air which is vented via a second port 76 to the atmosphere by way of canister vent valve 38. Port 74 is also connected to an inlet 78 of purge valve 40. The outlet 80 of this purge valve is connected to purge port 62 on the intake manifold. This allows fuel vapors from canister 36 and tank 60 to be supplied to the intake manifold via the purge valve 40. Purging of the canister and fuel tank is controlled by ECM 18 which operates purge valve 40 periodically to permit the vacuum existing in intake manifold 52 to draw purge gas from canister 36 and tank 60. Purge valve 40 is a solenoid-operated valve, with ECM 18 providing a duty cycled controlled signal 82 to regulate the flow rate of purge gas through valve 40 via current driver 84 to energize a coil (not shown) of purge valve 40. When the canister vent valve 38 is open during purging, fresh air is drawn into the canister via the vent valve and port 76, thereby allowing the fuel vapors to be drawn from the canister. When the canister vent valve is closed, the introduction of fresh air through port 76 is blocked, allowing fuel vapors to be drawn from the tank 60. This purge-on, vent-closed state is generally done for the purpose of diagnostics of the fuel tank 60 and EECS 12.

As will be described below, fuel control system 10 determines the appropriate control signal to current driver 84 so that the desired duty cycle of current is applied to the solenoid coil to actuate the solenoid plunger against the bias in a normally closed position. As is known, a high frequency is preferably applied to the solenoid to diminish noise and lower power consumption of the solenoid device when operating. However, as discussed above, high frequency hinders the linearity of the proportional function of the solenoid and increases the hysteresis of the system because the activation pulses are so close in time that they tend to meld with each other. When high frequency is applied, the plunger does not have enough time to cover the travel distance between the totally closed and the totally open points. Thus the plunger vibrates or "dithers" proportionally to the frequency. Dithering may be controlled if a current driver is used to generate a proportional function between the average current and the input duty cycle, however, this method requires a control loop that needs to measure the average current in real time. It will be recognized, however, that average current is difficult to determine. For that reason it is necessary to correlate the average current to something that is easy to compare in order to have an effective control loop.

Figure 2:
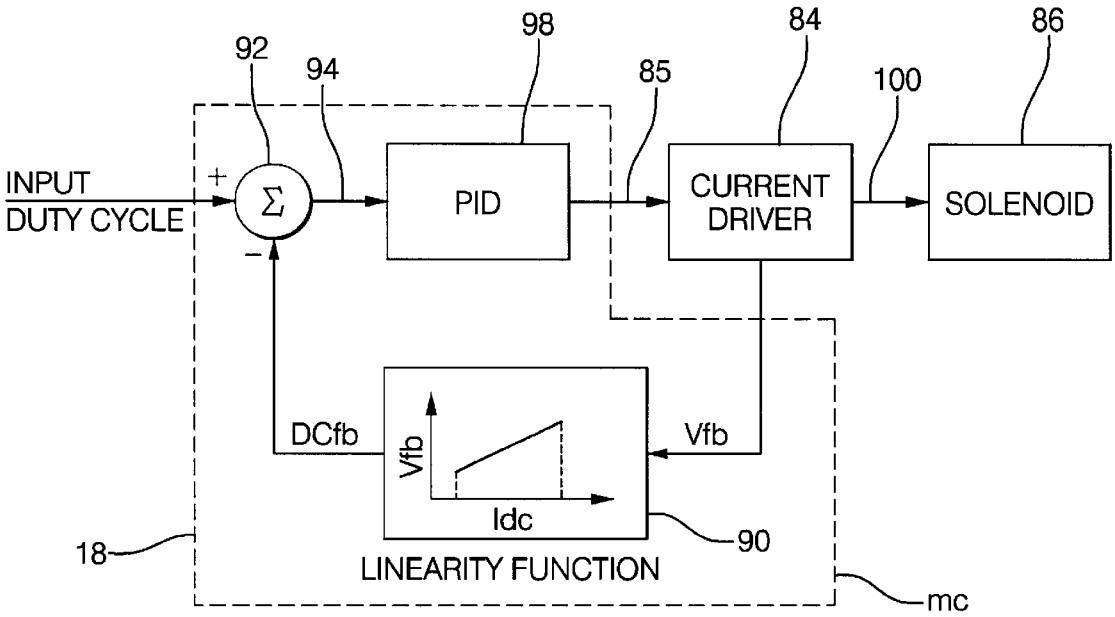
FIG. 2 is a process diagram depicting a control loop used in the electronic control module of FIG. 1 to provide system corrections based on input duty cycle and feedback voltage.

Referring to FIG. 2, an exemplary control diagram for solenoid purge valve compensation using current driver 84 connected to a linear purge valve solenoid 86 is shown. Purge valve compensation uses a control routine 110 based on the use of a voltage feedback (Vfb) of solenoid 86 that is easily measured in the system as indirect measurement of the average current applied. Voltage feedback (Vfb) is indicative of the average current (Iavg) if it is considered that the resistance of the solenoid is a constant set by the number of turns of the solenoid coil and that the power consumption remains proportional to the flow demands at a given duty cycle.

Therefore:

| [0001] Therefore: | |
|---|---|
| _____(1) Flow (Iavg) = m1*Iavg + b1 | [Flow rate is a function of Iavg] |
| _____(2) Iavg (Vfb) = m2*Vfb + b2 | [Iavg is a function of Vfb] |
| _____(3) [[/]]:. Flow (Vfb) = m3*Vfb + b3 | [Flow rate is a function of Vfb] |

where m1, m2, and m3 are the slope constants for the respective linear function and b1, b2, and b3 are the offsets or y-intercepts for each respective linear function. Based on these relationships, a control diagram for solenoid compensation is created using the feedback voltage Vfb from current driver 84. Current drivers 84 commercially available from Delphi Delco are suitable for use with the exemplary control routine described below.

In the solenoid control diagram shown in FIG. 2, an input duty cycle (Idc) is introduced into the system from ECM 18. Input duty cycle (Idc) is registered by ECM 18. However, it will be recognized that another microcontroller may be used. Idc is input to current driver 84 via signal 85. Current driver 84 then generates an output duty cycle 100 that is received by solenoid 86. Feedback voltage (Vfb) is picked off from current driver 84, however, it will be recognized that Vfb is optionally picked off from solenoid 86.

Feedback voltage Vfb picked off from current driver 84 is input in a reset function 90 in ECM 18 that uses feedback voltage Vfb to look up a corresponding feedback duty cycle (DCfb) that corresponds to the measured Vfb. In an exemplary embodiment, reset function 90 is a linearity function 90, however it will be recognized by those skilled in the pertinent art that other functions may be incorporated with linearity function 90 to produce a desired substantially linear output. For example, a quadratic or exponential function may be used to gain similar results, however, a linearity function will be described below in an exemplary embodiment.

Figure 3:
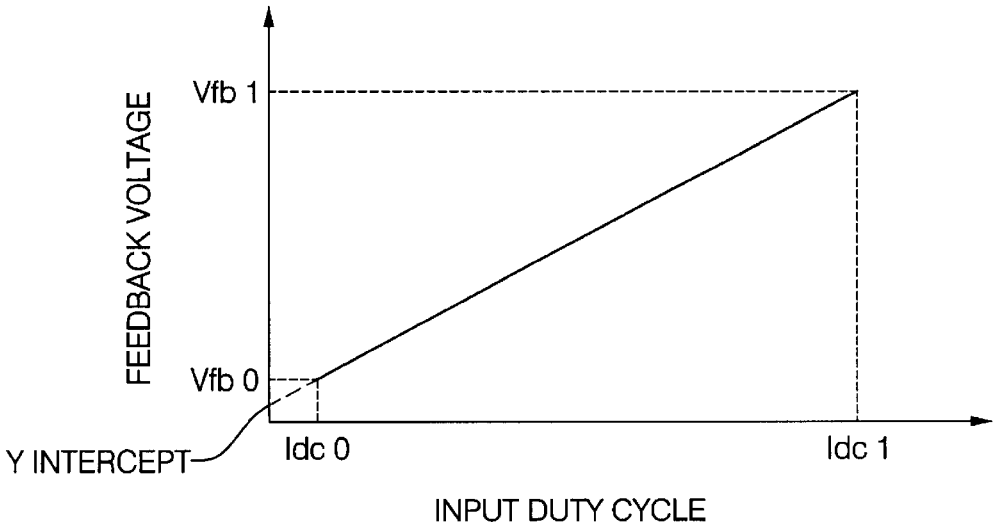
FIG. 3 depicts a graph showing a substantially linear function between the input duty cycle and feedback voltage employed in the electronic control module of FIG. 1.

ECM 18 then calculates an error value between the feedback duty cycle determined in linearity function 90 and the input duty cycle Idc for this particular duty cycle period. The error value is determined by inputting Idc and subtracting DCfb in a summer 92. Summer 92 generates an error signal 94 indicative of an existing error between Idc and DCfb. Error signal 94 is introduced into a proportional integral derivative (PID) control routine 98 in order to apply a PID generated rule to current driver 84. Current driver 84 then generates a refreshed output duty cycle 100 reflecting the compensation of the deviation from the linear function between an input duty cycle and a feedback voltage reflected in FIG. 3. The linearity function uses a set of programmable variables to change the slope (m) of the proportional curve in order to control the opening point of the solenoid and the solenoid's linear dynamic range by adjusting the offset (y-intercept). The set of programmable variables may be implemented as a look-up table having a matrix of cells that permit separate corrections to be applied as a function of a certain duty cycle. Each of these cells contains a voltage feedback correction factor, which is a data value that is applied at a certain duty cycle in order to control the average current applied to the solenoid coil. The programmable variables are stored in memory and are programmable for use in one type of vehicle to another, for example, in a mini-van to a sports sedan. It is optionally adjusted using the slope error term. In the linearity function 90, a programmed feedback voltage Vfb is applied at a certain duty cycle in order to control the average current Iavg that is applied to solenoid 86 as illustrated in FIG. 3. Linearity function 90 is incorporated as part of the compensation control loop to control the flow rate of a proportional linear valve solenoid 86 using current driver 84.

Figure 4:
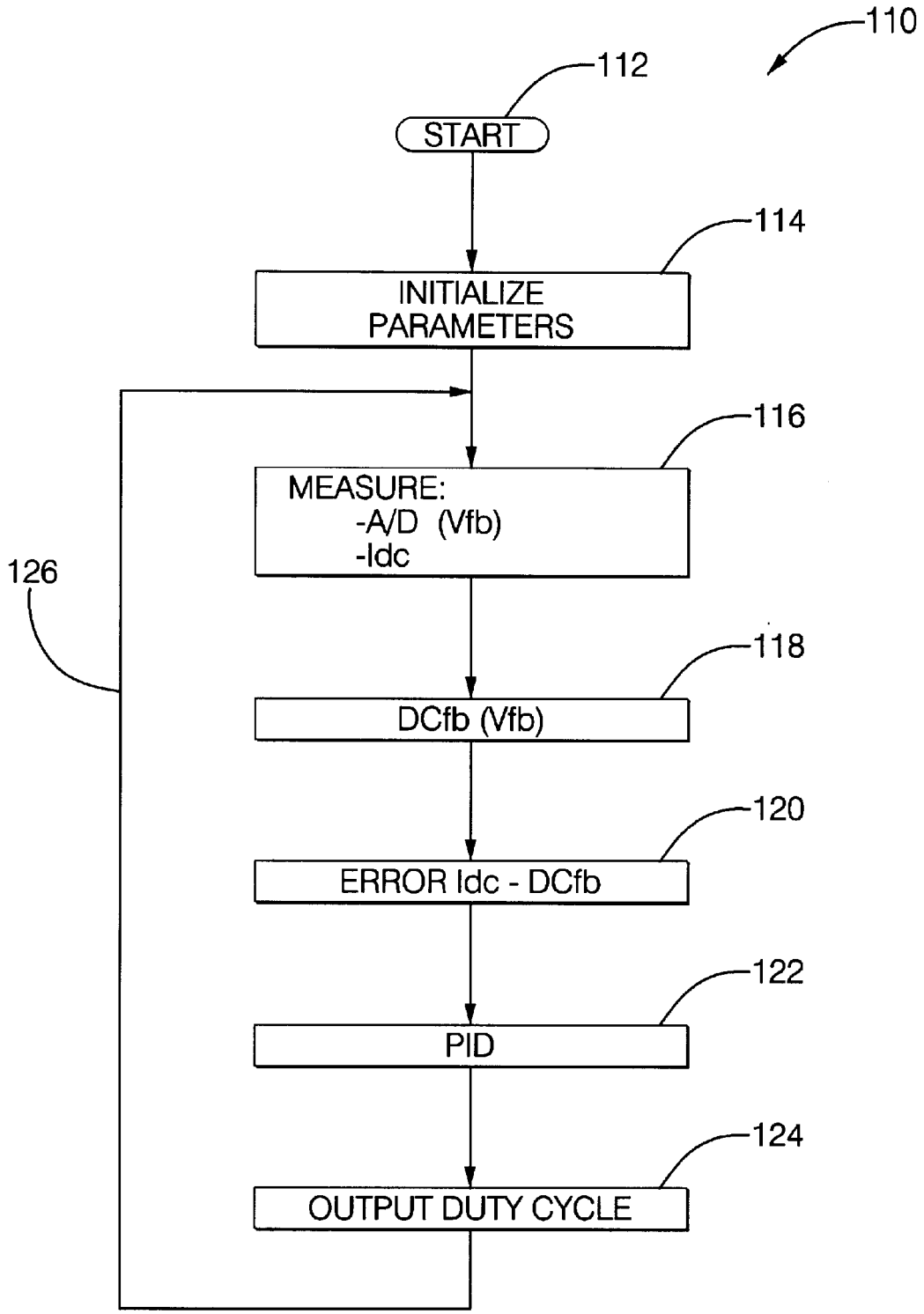
FIG. 4 is a flow chart showing the operation of the fuel control system of FIG. 1 over the course of a single duty cycle.

Turning now to FIG. 4, a flow chart representing the operation of ECM 18 under control of control routine 110 to regulate the average current Iavg applied to proportional linear valve solenoid 86 via current driver 84 is illustrated. The process begins at start block 112 and moves to block 114 to initialize parameters. Initialize parameters includes ECM 18 reading calibration parameters set in EEPROM to initialize peripherals (i.e., PWM registers). Block 114 adjusts linearity function 90 according to calibration parameters (e.g., slope (m) and offset (y-intercept)) as well as adjusting PID 98 controller coefficients. As discussed above, the process for determination of the average current applied to energize solenoid 86 is determined by measuring the set point input duty cycle (Idc) 82 and the feedback voltage (Vfb) at block 116. Idc and Vfb are converted to digital values using an A/D converter in ECM 18. Next, block 118 performs linearity function 90 using the measured feedback voltage obtained in block 116 to determine a feedback duty cycle (DCfb) that is a function of feedback voltage (Vfb). In block 120, the existing error for the current duty cycle period is determined by subtracting DCfb from Idc in summer 92 of ECM 18. A resulting error between Idc and DCfb is generated to PID 98 of ECM 18 at block 122 where a PID rule is applied to the error previously calculated at block 188. PID 98 is a controller that looks at the current value of the error, the integral of the error over a recent time interval (i.e., duty cycle period) and the current derivative of the error signal to determine not only how much of a correction to apply, but for how long. Then, at block 124, the proportional, integral, and duty cycle closed loop corrections are applied to produce a refreshed output duty cycle 85 and received by current driver 84 for use in solenoid 86. The refreshed output duty cycle 85 value becomes the new value for Idc at block 116 to repeat the process for successive duty cycle periods as indicated by flow arrow 126. Once the refreshed duty cycle is determined, the appropriate pulse width modulated control signal 100 is applied to solenoid 86 via current driver 84 to obtain a flow rate to the cylinder as a function of feedback voltage Vfb which correlates to an average current Iavg applied. The process then returns to block 116 for another cycle.

Thus, it will be appreciated that by iteratively updating the input duty cycle as a function of feedback voltage Vfb, the flow rate of fuel through purge valve 40 can be controlled and linearized using a high frequency pulse width modulated control signal without dithering or hysteresis. Moreover, the linear dynamic range can be expanded.

Figure 5:
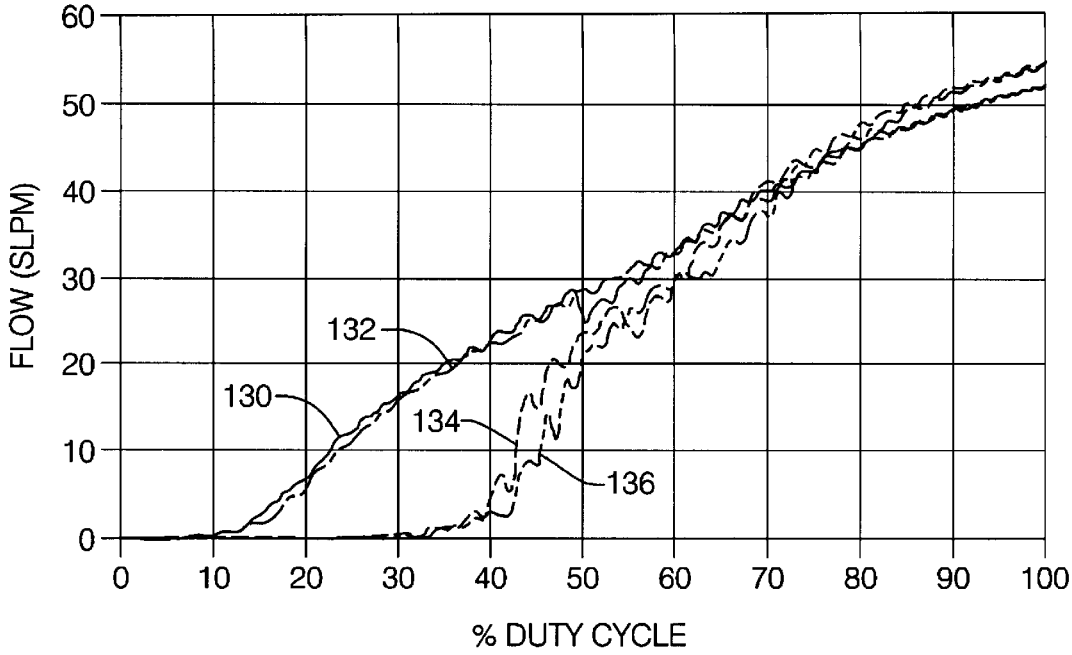
FIG. 5 is a graph showing the relationship between flow rate and duty cycle limit of the linear purge valve solenoid used in the evaporative emission control system of FIG. 1, with the graph further depicting a current driver without using the exemplary control routine and its effect on the linearity of duty cycle and flow rate of the solenoid.

The flow rate of the purge valve 40 is proportionately adjusted by ECM 18 by adjusting the duty cycle for switching of the purge valve 40 on and off. Referring back momentarily to FIG. 1, it will be appreciated that when the purge gas is drawn into intake manifold 52 through purge port 62, there is a propagation delay that is equal to the amount of time needed for plunger to travel the distance of fully closed to fully open when activated by Idc to allow the purge gas to flow from the purge port to the cylinder intake port 66. However, when switching purge valve 40 at the beginning or end of a purge cycle using a high frequency, the plunger transport delay introduces hysteresis in the system and decreases the linear and dynamic range of the flow rate curve indicated in FIG. 5. FIG. 5 shows four graphs representing examples of the purge valve flow rate as a function of duty cycle without incorporation of exemplary control routine 110. The two top plotted graphs 130, 132 represent flow rate as function of duty cycle when a vacuum of 15 kPa is applied simulating a vacuum applied by the intake manifold. The two bottom plotted graphs 134, 136 represent flow rate as a function of duty cycle when a vacuum of 60 kPa is applied. As can be seen by an inspection of these graphs 130, 132, 134, 136, hysteresis is present, most notably present when the flow rate in standard liter per minute (SLPM) is at or above a duty cycle of 40 percent. Moreover, the opening point of the solenoid is not until a duty cycle of about ten to about 30 percent is introduced, thus limiting the effective dynamic range of the flow curve.

Figure 6:
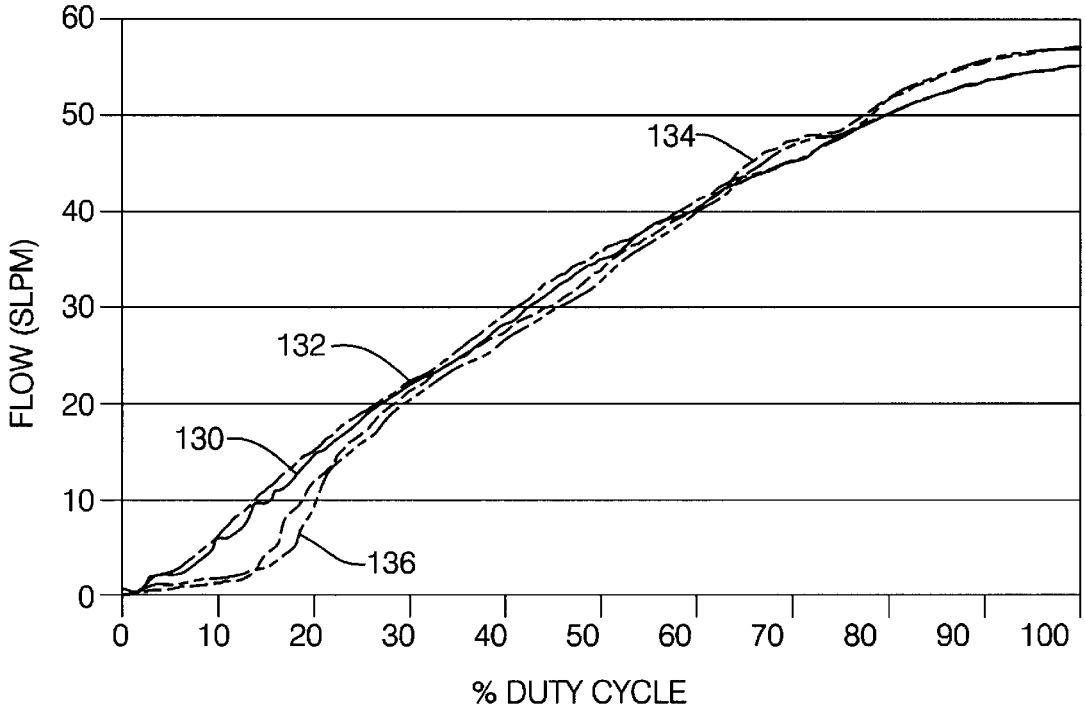
FIG. 6 is a graph showing the relationship between flow rate and duty cycle of the linear purge valve solenoid used in the evaporative emission control system of FIG. 1, with the graph further depicting a current driver using the exemplary control routine and its effect on the linearity of duty cycle and flow rate of the solenoid.

After some testing, various levels of the parameters for control routine 110 were selected, some of the results are reflected in FIG. 6. which include an increase of the linear and dynamic range of the flow curve, a decrease on the hysteresis of the flow and increased control of the opening point of the solenoid. FIG. 6 reflects a smoothing effect of the four plotted graphs in FIG. 5 which results when the linear purge solenoid with current driver is incorporated with exemplary routine 110. As shown in FIG. 6, the solenoid duty cycle linear range is expanded and hysteresis is reduced, while providing a precise opening point that occurs at a lower duty cycle percent.

In summary, the present disclosure discloses a control routine 110 for high frequency actuators that provides a method and apparatus to diminish the noise of a solenoid while providing a precise opening point, high accuracy, low hysteresis and a wide linear range using existing current drivers on a vehicle While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of controlling a solenoid-actuated charcoal canister purge valve to control the flow of purge fuel that is supplied via the purge valve to a cylinder intake passage of an internal combustion engine, the method comprising:

generating a preselected input duty cycle for use in energizing the solenoid-actuated purge valve, said duty cycle being registered by a microcontroller;

energizing the solenoid-actuated purge valve using the input duty cycle to generate an output duty cycle from a current driver in operable communication with said microcontroller, the output duty cycle to thereby supply a quantity of purge fuel to the cylinder;

measuring a feedback voltage (Vfb) from the solenoid-actuated purge valve, wherein the feedback voltage (Vfb) corresponds to a feedback duty cycle (DCfb);

calculating an error between the input duty cycle (Idc) and the feedback duty cycle (DCfb); and generating a compensated output duty cycle to the current driver based on said error to compensate any deviation, wherein said compensated output duty cycle compensates for any deviation from a linear relationship between the input duty cycle (Idc) and feedback voltage (Vfb), wherein Vfb corresponds to a flow rate of purge fuel.

2. The method of claim 1 wherein said error is received by a proportional integral derivative (PID) control routine in said microcontroller to generate said output duty cycle for compensating any deviation from the linear relationship between the input duty cycle (Idc) and feedback voltage (Vfb).

3. The method of claim 1 wherein said error is calculated using a reset function between the input duty cycle (Idc) and feedback voltage (Vfb).

4. The method of claim 3 wherein said reset function uses a programmed feedback voltage corresponding to a certain duty cycle to be applied to control the average current applied to the solenoid-actuated purge valve.

5. The method of claim 4 wherein said reset function uses a set of programmable variables, said set of programmable variable includes variables selected to change a slope of a proportional curve (Idc vs. Flow) for controlling at least one of an opening point and a linear dynamic range of the solenoid.

6. The method of claim 4 wherein said reset function uses a set of programmable variables, said set of programmable variable includes variables selected to change an offset or y-intercept of a proportional curve (Idc vs. Flow) for controlling at least one of an opening point and a linear dynamic range of the solenoid.

7. The method of claim 4 wherein said set of programmable variables correspond to use in at least one of different vehicles and different types of engines.

8. An evaporative control system for an internal combustion engine comprising:

a canister for temporarily holding fuel vapor from a fuel tank;

a purge passage for communicating the canister with an intake passage of the engine;

a purging control valve, located in the purge passage, for controlling an amount of fuel vapor purged into the intake passage;

duty cycle limiting means that, when a feedback voltage of the purging control valve corresponding to a feedback duty cycle (DCfb) that falls outside of an input duty cycle Idc, limits a duty cycle based on any deviation of the Idc from DCfb to a value within a set range, wherein the duty cycle indicates a ratio of an open time to total cycle time of the purging control allowing flow of fuel vapor therethrough;

duty cycle calculating means that, when there is an error between Idc and DCfb determines an output duty cycle relative the error between Idc and DCfb to the duty cycle limited by the duty cycle limiting means, the output duty cycle is generated to compensate the deviation from a linear function between Idc and Vfb; and purging control valve open/close control means for opening and closing the purging control valve at the duty cycle to provide a flow ratio calculated by the duty cycle calculating means.

9. An evaporative control system according to claim 8, wherein the duty cycle limiting means determines, on the basis of elapsed time since an onset of purging control measured by an elapsed time measuring means, whether the duty cycle should be limited to a value within the set range.

10. A control system for an internal combustion engine, said control system comprising:

a fuel adsorber connected between a fuel tank and the engine that adsorbs fuel vapor from the fuel tank;

a purge valve that is connected between the fuel adsorber and the engine that selectively opens to discharge the adsorbed fuel vapor from the fuel adsorber to the engine;

a purge controller that controls selective opening of the purge valve during discharge of the adsorbed fuel vapor to the engine to adjust the flow of fuel vapor quantity based on a purge control parameter that corresponds to an average current applied to the purge valve in correspondence with a duty cycle of the purge valve, and that corrects the purge control parameter as a function of the feedback voltage from the purge valve using a reset functions, wherein the reset function uses a set of programmable variables to change at least one of a slope and an offset or y-intercept of proportional curves relating to the relationship between input duty cycle and flow of fuel vapor through the purge valve, wherein the slope, offset and y-intercept controls the opening point and linear dynamic range of the purge valve operation.

11. The control system of claim 10 wherein the reset function uses the feedback voltage to calculate an error between a feedback duty cycle corresponding to the feedback voltage and an input duty cycle.

12. The control system of claim 11 wherein the error is received by a proportional integration derivative (PID) control routine configured to generate an output duty cycle to compensate for the error, the error corresponding to a deviation from a linear function between the input duty cycle and the feedback voltage.

13. The control system of claim 12 wherein reset function includes a programmed feedback voltage that applies a feedback duty cycle corresponding to the programmed feedback voltage.

14. The control system of claim 13 wherein the feedback duty cycle controls the average current applied to the purge valve.

15. An evaporated fuel treatment device for an engine provided with an intake passage, comprising:

a purge control valve for controlling an amount of fuel vapor to be purged to the intake passage;

feedback control means for feedback control of the average current applied to the purge control valve;

a duty cycle calculating means for calculating a duty cycle to be applied to the purge valve based on an amount of fluctuation of a feedback duty cycle corresponding to a feedback voltage of the purge control valve and an input duty cycle;

correcting means for correcting any deviation between the input duty cycle and the feedback duty cycle calculated by the duty cycle calculating means, the correcting means compensates the deviation using a reset function to provide an output duty cycle to a current driver.

16. The evaporated fuel treat device of claim 15 wherein said reset function optimizes a linear relationship between the input duty cycle and the flow of fuel vapor through the purge valve.

17. The evaporated fuel treatment device of claim 15 wherein the feedback control means includes the voltage feedback of the solenoid to indirectly measure and control the average current applied to the solenoid.

18. The evaporated fuel treat device of claim 15 wherein the reset function uses the feedback voltage to calculate an error between a feedback duty cycle corresponding to the feedback voltage and an input duty cycle.

19. The evaporated fuel treat device of claim 18 wherein the error is received by a proportional integration derivative (PID) control routine configured to generate an output duty cycle to compensate for the error, the error corresponding to a deviation from a linear function between the input duty cycle and the feedback voltage.

20. The evaporated fuel treat device of claim 19 wherein reset function includes a programmed feedback voltage that applies a feedback duty cycle corresponding to the programmed feedback voltage.

21. The evaporated fuel treat device of claim 20 wherein the feedback duty cycle controls the average current applied to the purge valve.

22. The control system of claim 18 wherein the reset function uses a set of programmable variables to change at least one of a slope and an offset or y-intercept of proportional curves relating to the relationship between input duty cycle and flow of fuel vapor through the purge valve, wherein the slope, offset and y-intercept controls the opening point and linear dynamic range of the purge valve operation.

* * * * *